US009017031B2

(12) United States Patent
Bottome

(10) Patent No.: US 9,017,031 B2
(45) Date of Patent: Apr. 28, 2015

(54) ANNULUS FILLER

(75) Inventor: Kristofer J. Bottome, Nottingham (GB)

(73) Assignee: Rolls-Royce plc, London (GB)

( * ) Notice: Subject to any disclaimer, the term of this patent is extended or adjusted under 35 U.S.C. 154(b) by 630 days.

(21) Appl. No.: 13/311,122

(22) Filed: Dec. 5, 2011

(65) Prior Publication Data

US 2012/0148388 A1 Jun. 14, 2012

(30) Foreign Application Priority Data

Dec. 9, 2010 (GB) ..... 1020857.7

(51) Int. Cl.
*F04D 29/08* (2006.01)
*F01D 11/00* (2006.01)

(52) U.S. Cl.
CPC ..... *F01D 11/008* (2013.01); *F05D 2250/32* (2013.01); *F05D 2250/70* (2013.01)

(58) Field of Classification Search
USPC ..... 416/193 A, 193 R, 190, 248, 194, 196 R, 416/195, 189
See application file for complete search history.

(56) References Cited

U.S. PATENT DOCUMENTS 5,193,982 A * 3/1993 Inizan et al. ..... 416/193 A
5,421,704 A * 6/1995 Carletti et al. ..... 416/193 A
6,217,283 B1 * 4/2001 Ravenhall et al. ..... 416/2
6,312,224 B1 * 11/2001 Knott et al. ..... 416/230
6,447,250 B1 9/2002 Corrigan et al.
2005/0276691 A1 12/2005 Queriault et al.
2009/0226318 A1 * 9/2009 Dimelow ..... 416/179
2010/0290910 A1 * 11/2010 Hoyland et al. ..... 416/193 R

FOREIGN PATENT DOCUMENTS

EP 1 067 274 A1 1/2001
EP 1 865 154 A1 12/2007
EP 1 881 160 A2 1/2008
WO WO 93/21425 A1 10/1993
WO WO 93/22539 A1 11/1993

OTHER PUBLICATIONS

British Search Report issued in Application No. 1020857.7; Dated Mar. 29, 2011.

* cited by examiner

*Primary Examiner* — Dwayne J White
*Assistant Examiner* — Justin Seabe
(74) *Attorney, Agent, or Firm* — Oliff PLC

(57) ABSTRACT

An annulus filler for mounting to a rotor disc of a gas turbine engine and for bridging the gap between two adjacent blades attached to the rotor disc. The annulus filler has a body portion including a lid which has a leading edge, a trailing edge and opposing side edges which connect respective ends of the leading and trailing edges. The lid defines an airflow surface for air being drawn through the engine. The annulus filler further has one or more attachment formations which, in use, connect the body portion to the rotor disc. The lid is configured such that the stiffness of the lid under compressive loading exerted on the opposing side edges by sideways blade movement is greater at the leading edge than at the trailing edge.

19 Claims, 4 Drawing Sheets

ANNULUS FILLER

FIELD OF THE INVENTION

The present invention relates to an annulus filler for mounting to a rotor disc of a gas turbine engine and for bridging the gap between two adjacent blades attached to the rotor disc.

BACKGROUND OF THE INVENTION

With reference to FIG. 1, a ducted fan gas turbine engine generally indicated at to 10 has a principal and rotational axis X-X. The engine comprises, in axial flow series, an air intake 11, a propulsive fan 12, an intermediate pressure compressor 13, a high-pressure compressor 14, combustion equipment 15, a high-pressure turbine 16, and intermediate pressure turbine 17, a low-pressure turbine 18 and a core engine exhaust nozzle 19. A nacelle 21 generally surrounds the engine 10 and defines the intake 11, a bypass duct 22 and a bypass exhaust nozzle 23.

The gas turbine engine 10 works in a conventional manner so that air entering the intake 11 is accelerated by the fan 12 to produce two air flows: a first air flow A into the intermediate pressure compressor 14 and a second air flow B which passes through the bypass duct 22 to provide propulsive thrust. The intermediate pressure compressor 13 compresses the air flow A directed into it before delivering that air to the high pressure compressor 14 where further compression takes place.

The compressed air exhausted from the high-pressure compressor 14 is directed into the combustion equipment 15 where it is mixed with fuel and the mixture combusted. The resultant hot combustion products then expand through, and thereby drive the high, intermediate and low-pressure turbines 16, 17, 18 before being exhausted through the nozzle 19 to provide additional propulsive thrust. The high, intermediate and low-pressure turbines respectively drive the high and intermediate pressure compressors 14, 13 and the fan 12 by suitable interconnecting shafts.

Each blade of the fan 12 is mounted on a rotor disc by inserting a root portion of the blade in a complementary retention groove in the outer face of the disc periphery. To ensure a smooth radially inner surface for air to flow over as it passes through the stage, annulus fillers can be used to bridge the spaces between adjacent blades. Typically, a seal between the annulus fillers and the adjacent fan blades is also provided by resilient strips bonded to the annulus fillers adjacent the fan blades. The fillers may be manufactured from relatively lightweight materials and, in the event of damage, may be replaced independently of the blades.

It is known to provide annulus fillers with features for removably attaching them to the rotor disc. An annulus filler may be provided with axially spaced hook members, the hook members sliding into engagement with respective parts of the rotor disc and/or a component located axially behind the rotor assembly, for example a rear fan air seal. FIG. 2 shows an example of such an annulus filler 32 viewed from the rear.

In use, the upper surface or lid 34 of the annulus filler 32 bridges the gap between two adjacent fan blades (not shown) and defines the inner wall of the flow annulus of a fan stage. The annulus filler 32 is mounted on a fan disc (not shown) by two hook members 36 and 38, respectively towards the forward and rearward ends of the annulus filler 32. It is also attached to a support ring (not shown) by a mounting feature 40. The two opposed side faces 42, 44 of the annulus filler are provided with respective seal strips 46, 48, and confront the aerofoil surfaces of the adjacent fan blades. Typically the annulus filler is a machined aluminium alloy forging.

SUMMARY OF THE INVENTION

In the event of a flan blade off (FBO) or foreign object impact (such as bird or ice impact), it is desirable for the annulus filler to absorb impact energy in such a way that the risk of loss or damage to the filler and the blade can be reduced.

Accordingly, a first aspect of the present invention provides an annulus filler for mounting to a rotor disc of a gas turbine engine and for bridging the gap between two adjacent blades attached to the rotor disc, the annulus filler having: a body portion including a lid and a support structure which supports the underside of the lid, the lid having a leading edge, a trailing edge and opposing side edges which connect respective ends of the leading and trailing edges, the lid defining an airflow surface for air being drawn through the engine, the support structure having side webs and a base plate having one or more attachment formations which, in use, connect the body portion to the rotor disc;

wherein the lid is configured such that the stiffness of the lid under compressive loading exerted on the opposing side edges by sideways blade movement is greater at the leading edge than at the trailing edge such that towards the trailing edge the side webs can move inwards towards the opposing side webs to induce buckling of the trailing edge of the lid between the side walls The greater stiffness at the leading edge is typically associated with a greater impact strength at this location, and helps the lid to withstand ice, hail or foreign object impact damage, which is more likely to be sustained at the front than at the rear of the lid. However, if, in operation, there is a large sideways deflection of the blades (e.g. caused by an FBO, or foreign object impact), then, notwithstanding the greater stiffness at the leading edge, the reduced stiffness at the trailing edge allows the lid to deform to accommodate the deflection, thereby reducing or eliminating damage that the lid might otherwise impose on the blade. This is particularly advantageous in respect of composite blades which tend to be more susceptible to contact damage with annulus fillers than metal blades.

The annulus filler may have any one or, to the extent that they are compatible, any combination of the following optional features.

The lid may be configured such that the lid can accommodate an at least 5% reduction, and preferably an at least 10% or 15% reduction, in the spacing between the two adjacent blades at the trailing edge by purely elastic deformation of the lid. This relatively high elastic deformability under lateral compression at the rear of the lid is typically associated with a high compliancy, such that the contact forces imposed on the blades by the lid are reduced.

The lid may be configured such that further reduction in the spacing between the two adjacent blades at the trailing edge can be accommodated by plastic deformation or disintegration of the lid rather than by plastic deformation or disintegration of the blades. Thus, even if the sideways blade movement is such that the lid reaches the limit of its elastic deformability, a relatively low ultimate strength for the lid can still help to ensure that the contact forces imposed on the blades by the lid are reduced.

The lid may consist of a front region which includes the leading edge of the lid and a rear region which includes the trailing edge of the lid, the rear region being more compliant than the front region under compressive loading exerted on the opposing side edges by sideways blade movement.

The lid can be configured such that, on cross-sections perpendicular to the axis of the disc, the stiffness of the lid under compressive loading exerted on the opposing side edges by sideways blade movement is greater adjacent its side edges than at its centre. Such an arrangement can help to promote elastic instability, e.g. buckling, of the lid under sideways compressive loading. Such cross-sections can be limited to a rear region of the lid to help ensure that the rear region is more compliant than a front region. The lid may have stiffening inserts at or adjacent its side edges to provide the variation in stiffness across a section. Alternatively, or additionally, on the cross-sections, the thickness of the lid may decrease from the side edges to the centre.

Conveniently, the lid, and optionally other parts of the body portion, can be formed from composite material. This facilitates the generation of different materials properties in different regions of the lid, helps to provide compatibility with composite blades, and can lead to a lighter filler. The annulus filler is typically self-loading in that, as a rotating component, the majority of forces on the filler are generated by its own mass. A lighter filler can therefore reduce its own internal forces as well as reducing forces on the rotor disc. More generally, reducing the mass of the engine contributes to improved airframe efficiency. Thus, the body portion can comprise a particle and/or fibre reinforced plastics material. Relative to a metal body portion, a composite material body portion offers high specific strength and stiffness but is generally more frangible, failing by brittle rather than ductile failure.

More particularly, the lid may be formed from continuous fibre-reinforced composite material, the reinforcing fibres in a front region of the lid being arranged in cross-ply formation with the directions of the fibres being from 30° to 60° away from the axis of the disc (ignoring any radial component of the fibre directions), and the directions of the reinforcing fibres in a rear region of the lid being from 0° to 15° away from the axis of the disc (again ignoring any radial component of the fibre directions). The cross-ply formation of the front region can help the lid to withstand impact damage, while the more axially aligned formation of the rear region can provide a reduced stiffness and strength in the hoop direction while providing an increased stiffness and strength in the axial direction to resist bending under centrifugal loading. Alternatively or additionally, at least the rear region may consist of a central sub-region formed from glass fibre reinforced composite material sandwiched between two side edge sub-regions formed from carbon fibre reinforced composite material. Glass fibre reinforced composite material tends to have a high strain capability but lower stiffness than carbon fibre reinforced composite material, which can help to promote elastic instability of the lid under sideways compressive loading.

The lid, or at least a rear region of the lid, may be formed from a rubber or rubber-like material. Such material tends to provide very high deformability and low stiffness. In this case, the body portion may include a support structure which supports the rubber or rubber-like material rear region. For example, the support structure can be co-moulded with the lid.

The annulus filler may further have one or more spring elements beneath the lid which return the body portion to shape after elastic deformation of the lid caused by sideways blade movement, Conveniently, the spring element may be a V-shaped, C-shaped or Ω-shaped spring. The spring element can be formed of composite material or a metal. It can be integrally formed with the body portion of the filler.

The annulus filler may have a front attachment formation which connects a forward end of the body portion to the rotor disc, and a rear attachment formation which connects a rearward end of the body portion to the rotor disc, the front and rear attachment formations allowing rotational movement of the body portion about a rotation axis which extends between the front and rear attachment formations. A fixing arrangement which allows such rotational movement can help to ensure that the filler remains attached to the disc, even when undergoing large deformations. More particularly, the front and rear attachment formations can comprise respective pivot pins which are located on the rotation axis and, in use, engage with corresponding engagement holes provided by the rotor disc to restrain the body portion against translational movement while allowing rotating about the rotation axis.

Typically, the blades are fan blades. For example, they may be composite material fan blades.

A second aspect of the present invention provides a stage for a gas turbine engine having:

a rotor disc, a plurality of circumferentially spaced apart blades attached to the rotor disc, and a plurality of annulus fillers according to the first aspect bridging the gaps between adjacent blades.

BRIEF DESCRIPTION OF THE DRAWINGS

Embodiments of the invention will now be described by way of example with reference to the accompanying drawings in which.

DETAILED DESCRIPTION

Figure 1:
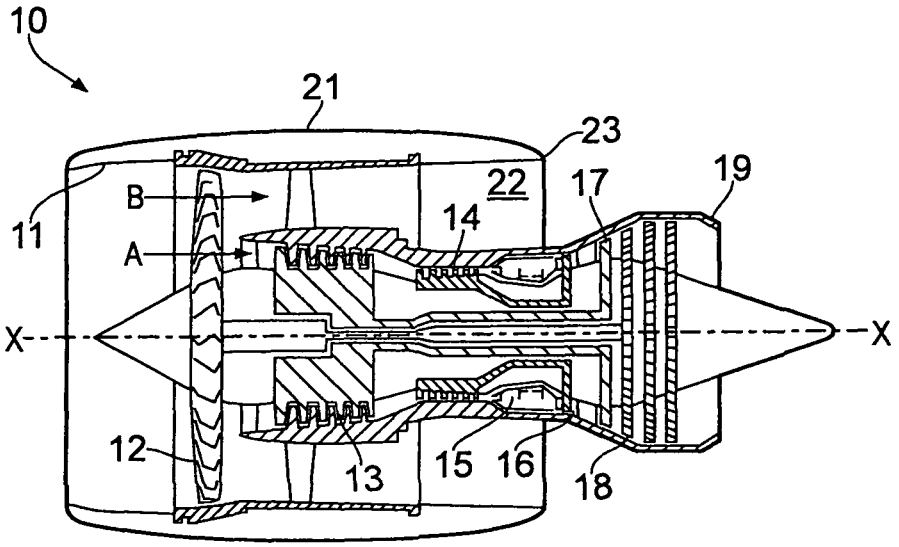
FIG. 1 shows a schematic longitudinal cross-section through a ducted fan gas turbine engine.
Figure 2:
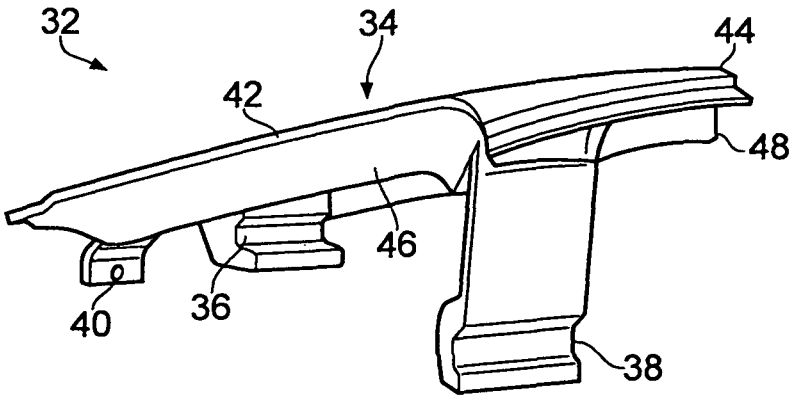
FIG. 2 PRIOR ART
FIG. 2 shows an example of conventional annulus filler viewed from the rear.
Figure 3:
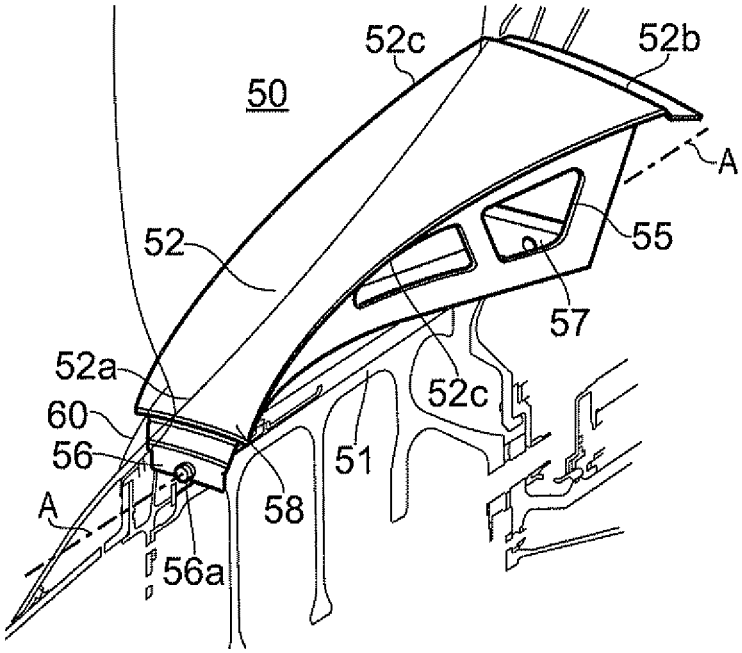
FIG. 3 shows a perspective view from the front of an annulus filler.
Figure 4:
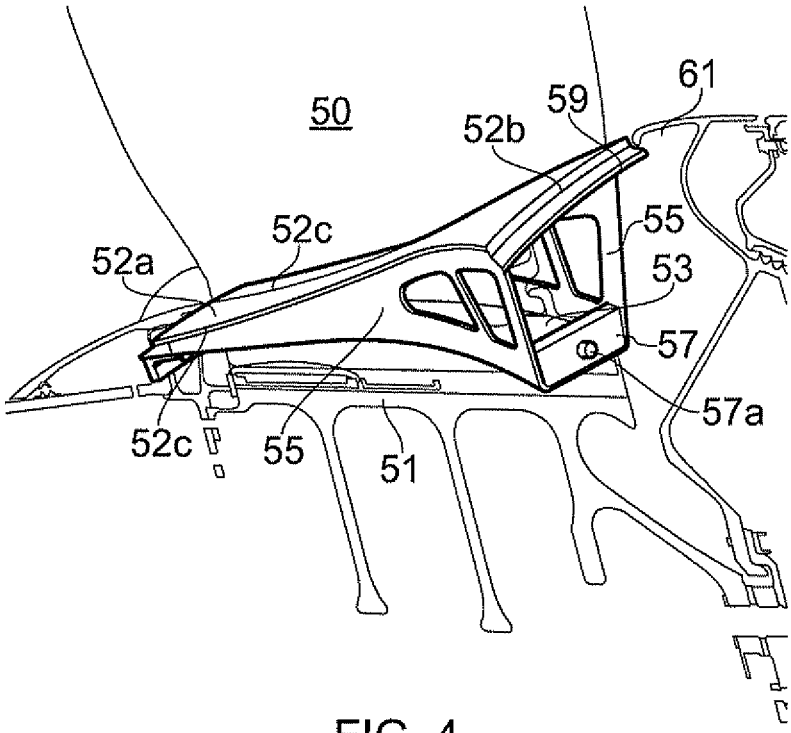
FIG. 4 shows a perspective view from the rear of the annulus filler of FIG. 3.

FIGS. 3 and 4 show perspective views from respectively the front and rear of an annulus filler for a fan rotor disc 51. The filler has a body portion comprising a lid 52 that, between leading 52*a*, trailing 52*b* and side 52*c* edges, defines an airflow surface for air being drawn through the engine. The lid bridges the gap between two adjacent fan blades 50 (only one shown in FIGS. 3 and 4), with the side edges extending along and conforming to the aerofoil surfaces of the blades.

The body portion also comprises a support structure supporting the underside of the lid. The support structure comprises a base plate 53 and left and right webs 55 which extend from side edges of the base plate to the side edges of the lid. The filler also has front 56 and rear 57 attachment formations at respectively the forward and rearward ends of the body portion for connecting the body portion to an outer surface of the rotor disc 51.

Each attachment formation 56, 57 is formed by a metal (e.g. aluminium, steel or titanium) or composite member at respectively the front or rear of the base plate 53 and spanning the two webs 55, and having a pivot pin 56*a*, 57*a* projecting outwardly from the plate and aligned along a rotation axis A extending between the attachment formation. Each pin engages with a corresponding hole provided by the rotor disc 51 to restrain the base plate against translational movement at its front and rear ends.

Figure 5:
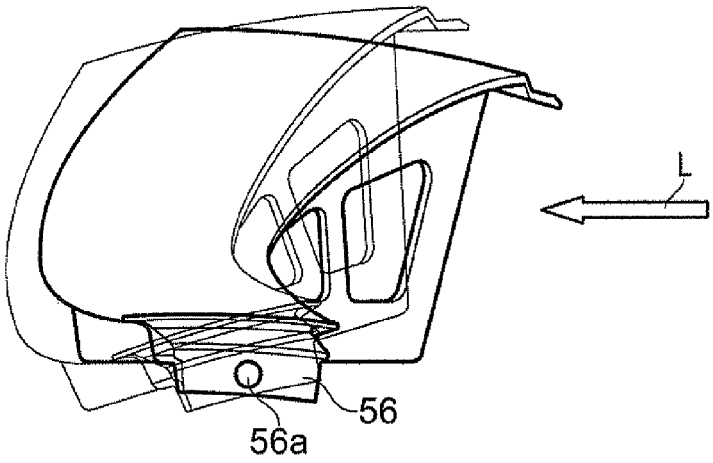
FIG. 5 shows a view from the front of the annulus filler of FIG. 3 with the filler being rotated about its attachment to the fan rotor by a lateral deflection of an adjacent fan blade.

However, as illustrated in FIG. 5, the filler can rock about the axis A when a sideways force is imposed on the filler, e.g. by lateral movement L of the blades 50 to either side of the filler caused by an FBO or foreign object impact.

Front 58 and rear 59 under-runnings extend from respectively the leading 52*a* and trailing 52*b* edges of the lid 52. The front under-runnings is supported under the engine nosecone 60 and the rear seal under the engine rear seal 61.

The lid 52 has materials properties which vary from its leading 52*a* to its trailing 52*b* edge. In particular, at the leading edge, the stiffness of the lid under compressive loading exerted on the side edges 52*c* by sideways movement of the blades 50 is relatively high compared to the stiffness of the lid under similar compressive loading at the trailing edge. The stiffened front end of the lid is associated with a relatively high strength which helps the lid to withstand ice, hail or foreign object impacts, such impacts being more prevalent towards the front of the lid. In contrast, the reduced stiffness of the rear end of the lid allows the lid to deform to accommodate the sideways movement of the blades. In this way, high contact loads on the blades can be avoided, which is particularly beneficial when the blades are formed of composite material, which tends to be susceptible to contact compared with metal.

Advantageously, the lid 52 and typically the support structure can be formed of composite material. This is particularly convenient for varying the materials properties of the lid from leading 52*a* to the trailing 52*b* edge. The typically reduced mass of a composite material component can also help to reduce internal forces within the filler as well as reducing forces on the rotor disc. In addition, the overall mass of the engine can be decreased. Further, particularly in relation to FBO events involving composite blades, a lighter, more frangible, composite material component can help to reduce blade damage.

The composite material can be a thermoset matrix, e.g. glass fibre or carbon fibre reinforcement in an epoxy, bismaleimide or polyester matrix, or can have thermoplastic matrix, e.g. PEEK, PEEK PEI, PPS or polyamide with glass or carbon reinforcement, Thermoplastic matrices, in particular, are suitable for injection moulding. However, a thermoset matrix can be used instead, e.g. produced by a pre-preg system, or by dry preforming and then injecting with resin using resin transfer moulding (RTM), vacuum assisted RTM, or the like. Preforms can be produced by fibre placement, tape laying/winding, 3D braiding, filament winding, or machine laid stitching etc. In general, the reinforcement can be continuous fibres, particulates or short fibres. The material can comprise a fibre reinforced plastic/metal laminate such as "GLAss-REinforced" fibre metal laminate (GLARE). Another option is to use a relatively low-cost, long chopped fibre, bulk moulding compound. This could have a fibre length of 25 mm or greater in an epoxy matrix system. Example materials are HexMC™ from Hexel, or MS-4A™ from YLA Composites. Such materials can be produced by a compression moulding system. Yet another option is to use a hybrid carbon/glass epoxy pre-preg which can combine the benefits of the relatively high strain capability of glass fibres and the relatively high strength of the carbon fibres. The lid 52 can be produced as a box type sections, e.g. using a fabric tape to wind onto a mandrel, and then filament winding or braiding over the top of the fabric. Such a pre-form could be RTM moulded.

Figure 6:
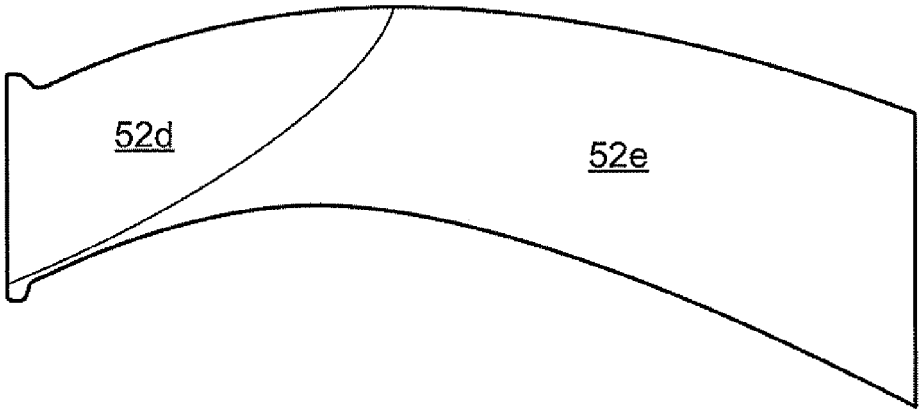
FIG. 6 shows schematically a top view of the lid of an annulus filler.

One option is to form the lid 52 in two regions, as illustrated in FIG. 6 which shows schematically a top view of the lid of an annulus filler. In a front region 52*d*, the lid is formed from continuous fibre-reinforced composite material, with the reinforcing fibres in a cross-ply formation. Ignoring any radial component of the directions of the reinforcing fibres, the fibre directions in the front region can be, for example, from 30° to 60° away from the axis of the rotor disc. In contrast, in a rear region 52*e* the lid is again formed from continuous fibre-reinforced composite material but now the reinforcing fibres more closely aligned with the axis of the rotor disc. For example, again ignoring any radial component of the directions of the reinforcing fibres, the fibre directions in the front region can be, for example, from 0° to 15° away from the axis of the rotor disc. With such a construction, the front region has stiffnesses in the hoop and fore-aft directions which are approximately equal. The cross-ply construction also helps to make the front region resistant to impact damage. The rear region, however, has a relatively low hoop stiffness and a relatively high fore-aft stiffness. This allows the rear region to deform readily under sideways loading from the adjacent blades, but to resist bending in the fore-aft under centrifugal loading. At the trailing edge 52*b*, the rear region can accommodate, for example, an at least 5% reduction, and preferably an at least 10% or 15% reduction, in the spacing between the adjacent blades 50 by purely elastic deformation of the lid. Preferably, if the lid has reached the limit of its elastic deformation but there is further sideways blade movement to accommodate, the lid then deforms plastically or disintegrates rather than the blade plastically deforming or disintegrating. Such behaviour can be achieved, e.g. ensuring a relatively low ultimate strength for the lid compared with the blade.

Varying the type and location of the reinforcement in a composite material lid can also help the lid 52 to deflect elastically under sideways loading. For example, carbon fibre reinforcement can be used at the side edges 52*c* of the lid, while glass fibre reinforcement can be used at the centre of the lid. As glass fibre has a lower stiffness than carbon fibre, but a high strain capability, this can encourage the lid to buckle elastically. If the filler were moulded from a reinforced thermoplastic, a similar effect could be achieved by using chopped fibre reinforcement in the support structure and particulate reinforcement in the lid. Alternatively, or additionally, the lid can be thickened towards its side edges and thinned towards its centre. Another way of encouraging elastic instability in the lid is to provide rigid (e.g. plastic or metal) supports at the side edges. These supports can extend, for example, from the webs 55 of the support structure. A relatively rigid support structure can allow at least the rear region of the lid to be formed from a highly flexible material, such as rubber of rubberised plastic.

Figure 7:
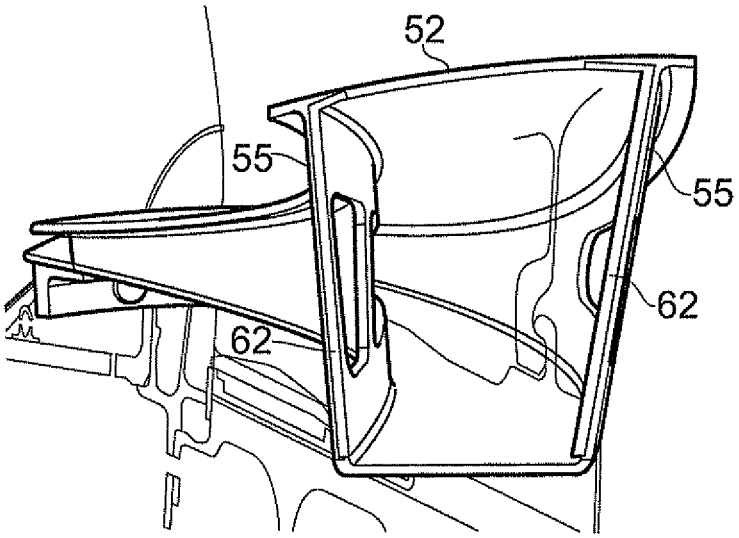
FIG. 7 shows a transverse cross-section through the annulus filler of FIG. 3 the cross-section being taken near the trailing edge of the lid of the filler.
Figure 8:
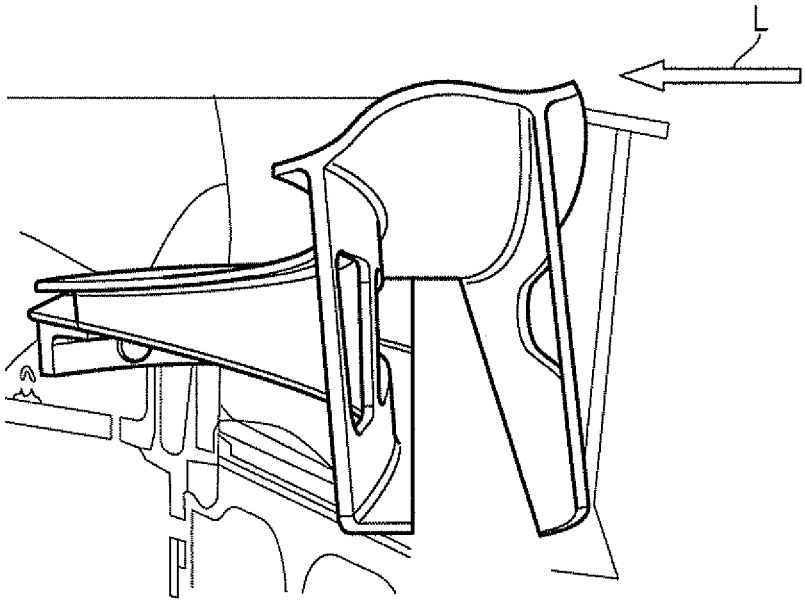
FIG. 8 shows the cross-section of FIG. 7 with the filler deflected by a sideways movement of an adjacent blade.

FIG. 7 shows, for example, a transverse cross-section through the annulus filler of FIG. 3 the cross-section being taken near the trailing edge 52*b* of the lid 52. The rear region of the lid is flexible and is constructed by one of the previously described approachs. Rigid support members 62 extend through the webs 55 and into parts of the lid adjacent its side edges 52*c*, but not into the centre of the lid. The support structure is co-moulded with the lid. When lateral movement L of an adjacent blade imposes a sideways loading L, as shown in FIG. 8, the unstiffened, central part of the lid elastically buckles to accommodate the movement While the invention has been described in conjunction with the exemplary embodiments described above, many other equivalent modifications and variations will be apparent to those skilled in the art when given this disclosure. For example, to assist the filler to return to its pre-deflected shape, one or more spring elements can be located beneath the lid, e.g. integrated with the support structure. The spring elements could, for example, compress during the sideways loading and then resile when the loading is removed. Accordingly, the exemplary embodiments of the invention set forth above are considered to be illustrative and not limiting. Various changes to the described embodiments may be made without departing from the spirit and scope of the invention.

The invention claimed is:

1. An annulus filler for mounting to a rotor disc of a gas turbine engine and for bridging a gap between two adjacent blades attached to the rotor disc, the annulus filler comprising:

a body portion including a lid and a support structure which supports an underside of the lid, the lid having a leading edge, a trailing edge, and opposing side edges which connect respective ends of the leading edge and the trailing edge, the lid defining an airflow surface for air being drawn through the engine, the support structure having side webs and a base plate having one or more attachment formations which, in use, connect the body portion to the rotor disc; wherein the lid comprises material properties that vary from the leading edge of the lid to the trailing edge of the lid, the material properties being configured to provide greater stiffness of the lid under compressive loading exerted on the opposing side edges by sideways blade movement at the leading edge than at the trailing edge, and the lid comprises material properties that vary between the opposing side edges of the lid toward the trailing edge to enable the side webs towards the trailing edge to move inwards towards one another to induce buckling of the trailing edge of the lid between the opposing side webs.

2. An annulus filler according to claim 1, wherein the lid is configured such that the lid can accommodate an at least 5% reduction in spacing between the two adjacent blades at the trailing edge by purely elastic deformation of the lid.

3. An annulus filler according to claim 2, wherein the lid is configured such that further reduction in the spacing between the two adjacent blades at the trailing edge can be accommodated by plastic deformation or disintegration of the lid rather than by plastic deformation or disintegration of the blades.

4. An annulus filler according to claim 1, wherein the lid comprises a front region which includes the leading edge of the lid and a rear region which includes the trailing edge of the lid, the rear region being more compliant than the front region under compressive loading exerted on the opposing side edges by sideways blade movement.

5. An annulus filler according to claim 4, wherein the lid is formed from continuous fibre-reinforced composite material, the reinforcing fibres in the front region being arranged in cross-ply formation with directions of the fibres being from 30° to 60° away from an axis of the disc ignoring any radial component of the fibre directions, and the directions of the reinforcing fibres in the rear region being from 0° to 15° away from the axis of the disc ignoring any radial component of the fibre directions.

6. An annulus filler according to claim 1, wherein the lid is formed from composite material.

7. An annulus filler according to claim 1, wherein the lid is formed from a rubber or rubber-like material.

8. An annulus filler according to claim 1, further comprising one or more spring elements beneath the lid which return the body portion to shape after elastic deformation of the lid caused by sideways blade movement.

9. An annulus filler according to claim 1, further comprising a front attachment formation which connects a forward end of the body portion to the rotor disc, and a rear attachment formation which connects a rearward end of the body portion to the rotor disc, the front attachment formation and the rear attachment formation allowing rotational movement of the body portion about a rotation axis (A) which extends between the front attachment formation and the rear attachment formation.

10. An annulus filler according to claim 9, wherein the front attachment formation and the rear attachment formation comprise respective pivot pins which are located on the rotation axis and, in use, engage with corresponding engagement holes provided by the rotor disc to restrain the body portion against translational movement while allowing rotating about the rotation axis.

11. An annulus filler according to claim 1, wherein the blades are fan blades.

12. An annulus filler according to claim 1, wherein at the trailing edge the side webs are connected only at the lid and the base.

13. An annulus filler according to claim 1, wherein a width of the lid increases between the leading edge and the trailing edge.

14. An annulus filler according to claim 4, wherein a width of the lid increases between the leading edge and the trailing edge.

15. An annulus filler according to claim 1, wherein the material properties that vary from the leading edge of the lid to the trailing edge of the lid include: the lid comprising a first material toward the leading edge, and a second material toward the trailing edge, the first material having a greater stiffness than the second material in a direction perpendicular to a longitudinal axis of the annulus filler.

16. An annulus filler according to claim 1, wherein the material properties that vary between the opposing side edges of the lid toward the trailing edge include any one of more of:

stiffening inserts adjacent the side edges;

the thickness of the lid decreasing from the side edges to the centre of the lid; and the lid comprising a first material at the side edges of the lid, and a second material at the centre of the lid, the second material having a lower stiffness than the first material.

17. A stage for a gas turbine engine comprising:

a rotor disc, a plurality of circumferentially spaced apart blades attached to the rotor disc, and a plurality of annulus fillers bridging a map between two adjacent blades attached to the rotor disc, the annulus filler comprising:

a body portion including a lid and a support structure which supports an underside of the lid, the lid having a leading edge, a trailing edge, and opposing side edges which connect respective ends of the leading edge and the trailing edge, the lid defining an airflow surface for air being drawn through the engine, the support structure having side webs and a base plate having one or more attachment formations which, in use, connect the body portion to the rotor disc; wherein the annulus filler comprises material properties that vary from the leading edge of the lid to the trailing edge of the lid, the material properties being configured to provide greater stiffness of the lid under compressive loading exerted on the opposing side edges by sideways blade movement at the leading edge than at the trailing edge, and the annulus filler comprises material properties that vary between the opposing side edges of the lid toward the trailing edge to enable the side webs towards the trailing edge to move inwards towards one another to induce buckling of the trailing edge of the lid between the opposing side webs.

18. A stage for a gas turbine engine according to claim 17, wherein the lid is formed from continuous fibre-reinforced composite material, the reinforcing fibres in a front region of the lid being arranged in cross-ply formation with the directions of the fibres being from 30° to 60° away from an axis of the disc ignoring any radial component of the fibre directions, and the directions of the reinforcing fibres in a rear region of the lid being from 0° to 15° away from the axis of the disc ignoring any radial component of the fibre directions.

19. A stage for a gas turbine engine according to claim 17, wherein a width of the lid increases between the leading edge and the trailing edge.

* * * * *